United States Patent [19]

Giebel et al.

[11] Patent Number: 4,777,685

[45] Date of Patent: Oct. 18, 1988

[54] MACHINE FOR PULLING OVER AND LASTING TOE PORTIONS OF SHOE UPPERS

[75] Inventors: Gerhard Giebel, Bad Soden; Manfred Broening, Frankfurt am Main; Rudi Fichtner, Rossbach, all of Fed. Rep. of Germany

[73] Assignee: DVSG Patentverwaltung G.m.b.H, Frankfurt am Main, Fed. Rep. of Germany

[21] Appl. No.: 116,718

[22] PCT Filed: Mar. 13, 1987

[86] PCT No.: PCT/GB87/00175

§ 371 Date: Oct. 29, 1987

§ 102(e) Date: Oct. 29, 1987

[87] PCT Pub. No.: WO87/05476

PCT Pub. Date: Sep. 24, 1987

[30] Foreign Application Priority Data

Mar. 13, 1986 [DE] Fed. Rep. of Germany ..... 8606125

[51] Int. Cl.[4] ..... A43D 21/16; A43D 21/00

[52] U.S. Cl. ..... 12/12; 12/12.4

[58] Field of Search ..... 12/12.4, 10.5, 12, 12.2, 12/8.8, 10.8, 14.3, 14.4

[56] References Cited

U.S. PATENT DOCUMENTS

| | | | |
|---|---|---|---|
| Re. 26,860 | 4/1970 | Becka | 12/145 |
| 2,039,448 | 5/1936 | Pym | 12/12.2 |
| 3,011,186 | 12/1961 | Kamborian | 12/8.8 |
| 3,165,771 | 1/1965 | Kamborian | 12/10.5 |
| 4,319,373 | 3/1982 | Lauckhardt et al. | 12/8.3 |
| 4,530,124 | 7/1985 | Sommer | 12/12.4 |
| 4,627,124 | 12/1986 | Winter | 12/12.4 |
| 4,649,584 | 3/1987 | Giebel | 12/12.4 |
| 4,653,133 | 3/1987 | Giebel | 12/12.4 |

FOREIGN PATENT DOCUMENTS

| | | | |
|---|---|---|---|
| 0100636 | 2/1984 | European Pat. Off. | 12/12.2 |
| 681816 | 9/1939 | Fed. Rep. of Germany . | |

*Primary Examiner*—Steven N. Meyers

[57] ABSTRACT

In a hydraulically operated pulling over and toe lasting machine both the operative position of the heel support (26), i.e. in which it holds the shoe by engagement with its heel end, and the position from which it initially moves to engage the shoe (the "next start" position) are controlled by electronic circuitry. Thus, an inductance switch (118) is actuated when the heel pad (100) engages the heel end of the shoe, said switch causing the supply of fluid to be shut off and locking the heel support in its operative position. For setting the "next start" position, on the other hand, selector switches (122,124) are provided each of which has an associated timer (T1,T2). At the end of a lasting cycle the heel support (26) is first fully retracted and then moves to its "next start" position under the control of the timer associated with the selected switch.

9 Claims, 4 Drawing Sheets

MACHINE FOR PULLING OVER AND LASTING TOE PORTIONS OF SHOE UPPERS

This invention is concerned with a machine for pulling over and lasting toe portions of shoe uppers comprising a toe support for supporting, bottom down, the toe end portion of a shoe comprising a shoe upper on a last with an insole on the last bottom, and a pincer assembly comprising an array of pincers disposed about the toe support for gripping lasting marginal portions of the toe end of the upper of a shoe supported by the toe support, wherein relative movement is effected, in a direction heightwise of the shoe, between said toe support and said pincer assembly whereby, with the lasting marginal portions of the shoe upper gripped as aforesaid, the toe end portion of the shoe upper can be tensioned over its last, the machine further comprising a heel support which is movable towards and away from the toe support between an operative position, in which the heel end portion of the shoe is engaged and supported thereby, and a position which it occupies in the rest condition of the machine (its "next start" position), means for moving the heel support between its operative and "next start" positions, and wiper means by which the lasting marginal portions of the toe portion of the shoe upper can be wiped over and pressed against corresponding marginal portions of the insole for securement thereto.

Machines of the aforementioned type are well known in the prior art. Such machines may be pneumatically or hydraulically controlled.

In operating machines of the aforementioned type, it is possible, by a manual unclamping, re-positioning and re-clamping sequence, to move the mounting for the heel support in order to accommodate different sizes of shoe. Otherwise, the machine has to be set up for the largest size of shoe, with the consequence that, when operating on small-sized shoes, the time taken to travel between the "next start" position and the operative position is unacceptably long, in terms of the length of the machine cycle and thus of the machine's productivity. Adjusting the heel support position, however, is itself disadvantageous in terms of productivity, especially where a wide range of shoe sizes is being processed through the machine.

On the other hand, where the operator is allowed to set the heel support position according to shoe length, an operator may, in attempting to reduce to a minimum the rturn movement of the heel support, so set the position that a shoe which has been operated upon is not readily ejected from the machine; it will of course be appreciated that ejection of a finished shoe usually takes place by allowing the heel support to be sufficiently retracted to enable the shoe to fall unimpeded out of the operating locality. Any impediment to the automatic ejection of shoes is of course in itself damaging to the productivity of the machine.

It is thus the object of the present invention to provide an improved machine for pulling over and lasting toe portions of shoe uppers, wherein the setting of the position of the heel support according to shoe length is facilitated, while minimising the risk of preventing ejection of the finished shoe as aforesaid.

This object is resolved in accordance with the present invention, in a machine as set out in the first paragraph above, in that the heel support has a plurality of pre-set "next start" positions, operator-actuatable selector means being provided for selecting one of said positions according to the size of the next shoe to be operated upon, and in that the heel support, in moving from its operative position, is first moved to a retracted position, in which the shoe held thereby is released, and thereafter, according to the selection of the operator, assumes its selected "next start" position.

It will thus be appreciated that, using such an arrangement, the operator merely needs to select the appropriate "next start" position, which position may be pre-set by factory management or indeed in the course of initial assembly of the machine, so that adjustment by the operator, and any time required for manually effecting it, is eliminated. Furthermore, by retracting the heel support fully at the end of each machine cycle, the automatic ejection of the shoe is ensured to the maximum extent possible.

For limiting the number of "next start" positions which need to be provided, conveniently the retracted position constitutes one of the selectable "next start" positions.

In one embodiment of the invention, which is pneumatically operated, the setting of the heel support in a selected "next start" position is achieved by providing a pneumatic cylinder which is ancillary to the means for moving the heel support between its operative and "next start" positions, the arrangement being such that the ancillary piston-and-cylinder arrangement is operated, according to the selection made by the operator, to move the heel support between two such "next start" positions. It will also be appreciated that, if more than two "next start" positions are required, then a plurality of such ancillary piston-and-cylinder arrangements, cooperating with one another, will be required. When the selected "next start" position has been reached, furthermore, a locking system, e.g. a bar locking system, is rendered operative to lock the heel support in the selected position. Alternatively, in another embodiment of the invention, the means for moving the heel support is hydraulically operated and electronic control circuitry is provided which incorporates a clock function, under the control of which the movement of the heel support from its retracted position to its selected "next start" position takes place for a pre-set time interval. By this arrangement, it wil be appreciated, no ancillary piston-and-cylinder arrangement is required, and similarly no bar locking arrangement is required, but rather the clock function, in conjunction with other parts of the control circuitry, can be utilised to enable any desired number of different "next start" positions to be pre-set.

Conveniently, in such embodiment, furthermore, the selector means comprises a plurality of selector switches, with each of which one "next start" position is associated, the arrangement being such that the status of each switch is monitored by the electronic circuitry, which controls the movement of the heel support as aforesaid according to which of the switches is actuated. In the control of this invention, each such switch may be constituted by a separate switch unit, e.g. a push-button, or by one position of a multi-position switch.

The electronic control circuitry may also be used in determining the operative position of the heel support and to this end preferably the means for moving the heel support into and out of its operative position includes a solenoid valve, and sensor means is provided actuatable by engagement of the heel support with the heel end portion of a shoe supported by the toe support, the status of the sensor means being monitored by the electronic control circuitry and, in the event of actuation of said means, said solenoid valve, actuation of which causes the heel support to move in a direction towards the toe support, being caused by said circuitry to be de-actuated whereupon the heel support is locked in such position (its operative position). Where the means for moving the heel support into its operation position is hydraulically operated, furthermore, actuation of the sensor means is effective to cause the solenoid valve to be de-actuated to a fluid locking position, thus to lock the heel support in its operative position. In this way the heel support is accurately positioned according to the length of the shoe being held thereby on the one hand without the need to maintain pressure on the heel support (which in a subsequent part of the operating cycle could serve to dislodge the shoe) and, on the other hand without the need for any retraction of the heel support, which is a feature of mechanical locking systems, e.g. a bar lock arrangement.

For accommodating the sensor means and facilitating its operation, the heel support conveniently comprises a heel pad which is mounted for movement relative to a fixed support member of the heel support, such relative movement being sensed by and serving to actuate the sensor eans. In a preferred embodiment, furthermore, the heel pad is mounted on a support plate which is mounted for pivotal movement in relation to said fixed support member, such pivotal movement being sensed by and thus serving to actuate the sensor means.

In the operation of machines of the aforementioned type, it is known that in the course of the operating cycle thereof there is a tendency for some heightwise movement of the shoe to take place and in some circumstances the heel end portion thereof can thus move relative to the heel pad. In said preferred embodiment of the present invention, therefore, the heel pad is carried by a slide which is mounted on the support plate for sliding movement relative thereto in a direction heightwise of the shoe. In addition, in order that the heel pad can accommodate to the particular shape of the back of the shoe, the heel pad is mounted for pivotal movement on said slide.

The sensor means may be of any desired type which is actuatable in response to movement of one component relative to another, but preferably comprises an inductance device which is carried by said fixed support member and with which cooperates an actuator movable with the heel pad, movement of the actuator into proximity with the inductance device serving to actuate the sensor means as aforesaid.

There now follows a detailed description, to be read with reference to the accompanying drawings, of one machine in accordance with the invention. It will of course be appreciated that this machine has been selected for description merely by way of non-limiting example of the invention.

In the accompanying drawings

Figure 1:
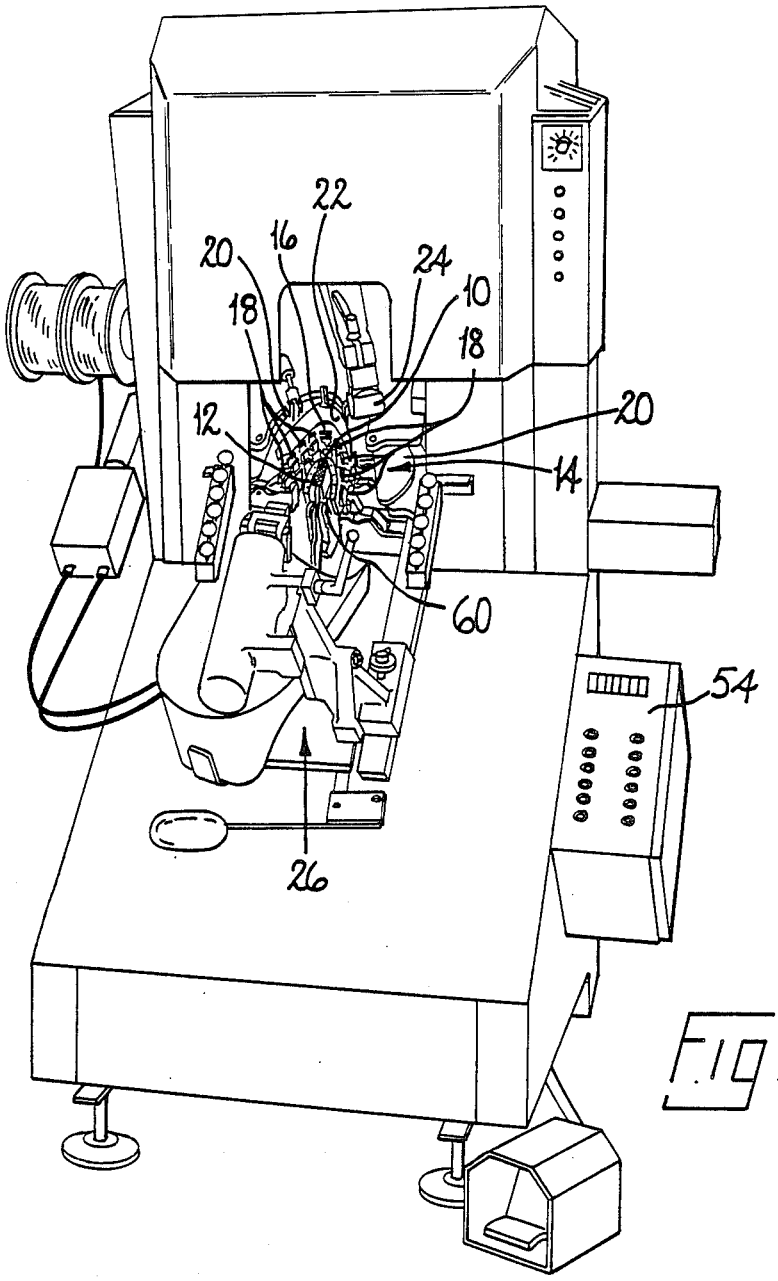
FIG. 1 is a front perspective view of the machine in accordance with the invention to be described.

The machine now to be described is a hydraulically operated pulling over and toe lasting machine comprising a toe support 10 which is elongated in the lengthwise direction of a shoe to be supported thereby and is surrounded, at its toe end, by an imprinter plate 12 forming part of adhesve-applying means of the machine. Arranged in an array about the outside of the imprinter plate 12 is a pincer assembly generally designated 14 and comprising a toe pincer 16 and, at each side thereof, four side pincers 18. Lying slightly outside the pincer assembly 14 is a pair of wiper plates 20 which, in their rest position, are separated, but, in operation, are first moved together and then pivoted about an interlocking button arrangement and are thus advanced downwardly towards the shoe and inwardly over the pincer assembly. (Details of such a wiper assembly are to be found in GB-A No. 1347875.) Disposed above the wiper plates 20 is a toe band 22 which engages the toe end of a shoe supported by the toe support 10 while leaving unclamped the depending lasting marginal portions of the toe end portion of the shoe upper. Above the toe support 10 and to one side thereof is a toe pad 24 which is movable firstly into a position in opposed relationship with the toe support and thereafter downwardly theretowards, the toe pad cooperating with the wiper plates 20 to apply bedding pressure to the shoe in the course of the lasting operation. (Details of the toe band construction and its mode of operation are to be found in GB-A No. 1351192.) The machine also comprises a heel support arrangement generally designated 26 by which the heel end portion of a shoe is engaged, during the lasting cycle, in order to support the heel end of the shoe, as will be described hereinafter. It will thus be appreciated that the machine is generally similar, except as hereinafter described, to a conventional so-called "fixed head" pulling over and toe lasting machine.

Figure 2:
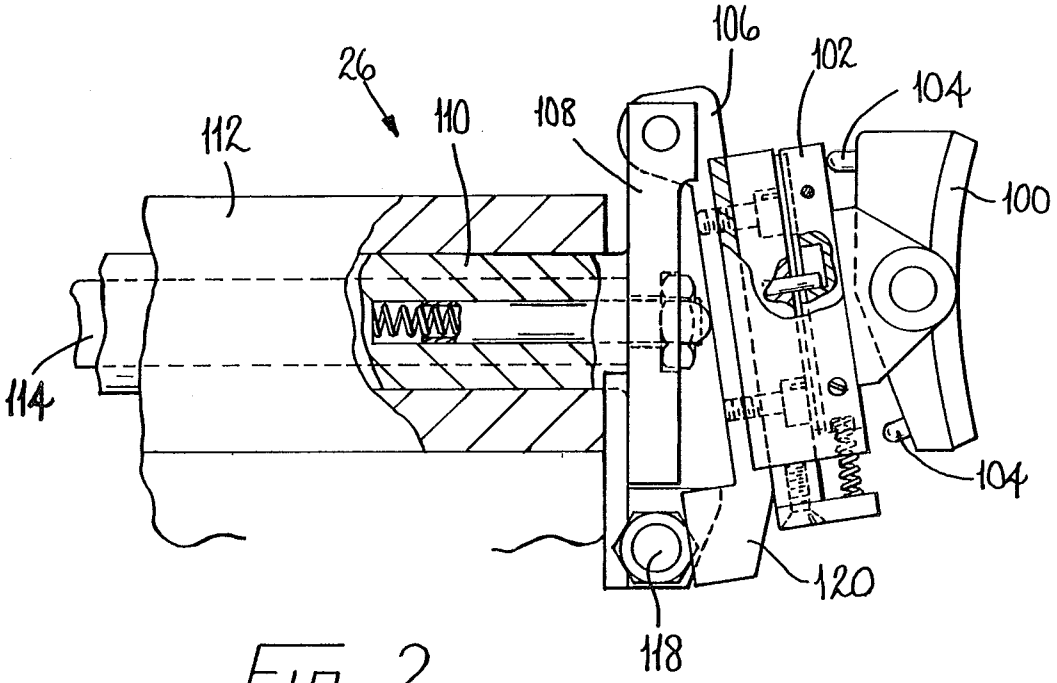
FIG. 2 is a side elevational view showing details of a heel support of the machine.

Turning to FIG. 2, the heel support arrangement 26 comprises a heel pad 100 which is pivotally mounted on a block 102, adjustable stop pins 104 being provided on the pad for limiting its pivoting movement. The block 102 is mounted for sliding movement on a bracket member 106 which is itself mounted for pivotal movement on a fixed support plate 108 mounted at the end of a piston rod 110 of piston-and-cylinder arrangement 112. The latter is mounted on a frame portion 114 (FIG. 1) of the machine in a conventional manner. For preventing rotation of the heel support arrangement about the axis of the piston rod 110, a stabiliser rod 116 extends parallel with the piston rod, is fixed at its forward end to the support plate 108 and is captive in the frame portion 114.

The support plate 108 carries at one side thereof, adjacent its lower edge, an inductance device 118 constituted by a proximity switch which is actuated by an actuator plate 120 carried on the bracket member 106. In the operation of the machine, when the heel pad engages the heel end of a shoe supported by the toe support, the heel pad, having pivoted on the block 102 to accommodate to the shape of the shoe, then causes the bracket member 106 to pivot on the support plate 108, bringing the actuator plate 120 into proximity with the inductance device 118, whereupon a signal is supplied that the heel pad is now in its operative position.

Figure 3:
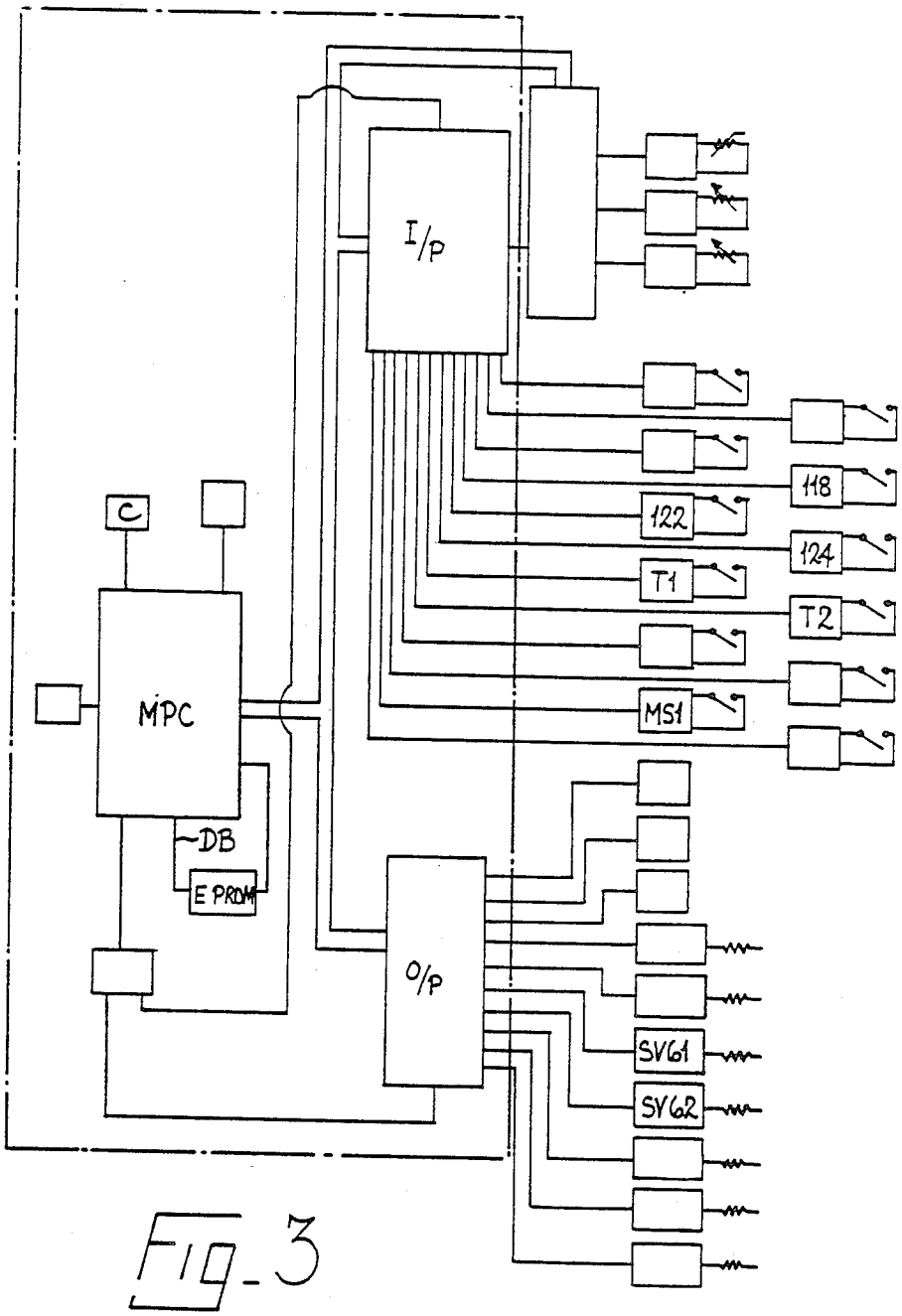
FIG. 3 is a block diagram of electronic circuitry of the machine.

For controlling the supply of hydraulic fluid to the arrangement 112 a three-position valve SV6 (not shown), is provided, operable under the control of two solenoids SV61, SV62 (FIG. 3). A first SV61 of said solenoids is energised to open the valve to allow hydraulic fluid to piston-and-cylinder arrangement 112, until inductance device 118 is actuated as aforesaid, whereupon the solenoid is de-energised and the valve switch is to its central, fluid locking, position. The heel support is thus locked in its operative position until the end of the second stage of the lasting procedure, when the other solenoid SV62 is actuated, thus withdrawing the heel pad (and de-actuating the inductance device 118). When fully retracted (the end of stroke of the piston-and-cylinder arrangement 112 being signalled by a microswitch MS1), solenoid SV62 is itself de-actuated. The heel support is now in its "shoe release" position.

It will be appreciated that the machine now being described can be used for operating on shoes of different sizes so that, if the full stroke of piston-and-cylinder arrangement 112 is used in moving the heel pad from its rest position into its operative position, then the cycle time for the machine will vary considerably according to whether the shoe is large or small. In the machine in accordance with the invention, therefore, it is possible to select a "next start" position according to the size of shoe. To this end, on a control panel 54 (FIG. 1) of the machine are provided a plurality of (in this case two) selector buttons 122, 124 by which appropriate "next start" positions can be selected.

In the operation of the machine, whichever "next start" position is selected, the heel pad 100 is first withdrawn away from the toe support through the whole stroke of piston-and-cylinder arrangement 112 to the "shoe release" position. This ensures that regardless of the "next start" position selected for the next shoe, the heel pad will be fully retracted and furthermore, by fully retracting the pad, it is ensured that the shoe which has just been operated upon is released and can drop into a tray 28 (FIG. 1) provided therefor.

The machine in accordance with the invention also comprises electronic control means in the form of a programmable controller, which includes a microprocessor, together with associated circuitry as shown in FIG. 3. The programmable controller is a commercially available unit incorporating a microprocessor MPC and one or more EPROMs connected via data bus DB, together with input and output ports I/P, O/P connected to the microprocessor through a bus I/OB. The circuitry of the controller is shown in block diagram form with the chain-dot line indicated in FIG. 3, and includes a clock function C, which will be referred to hereinafter. (One suitable programmable controller is supplied by InterControl Hermann Koehler Elektrik GmbH & Co. K.G. under the trade name 'DIGSY'.) The various inputs and outputs shown in FIG. 3 have already been or will be referred to in the following description.

Figure 4:
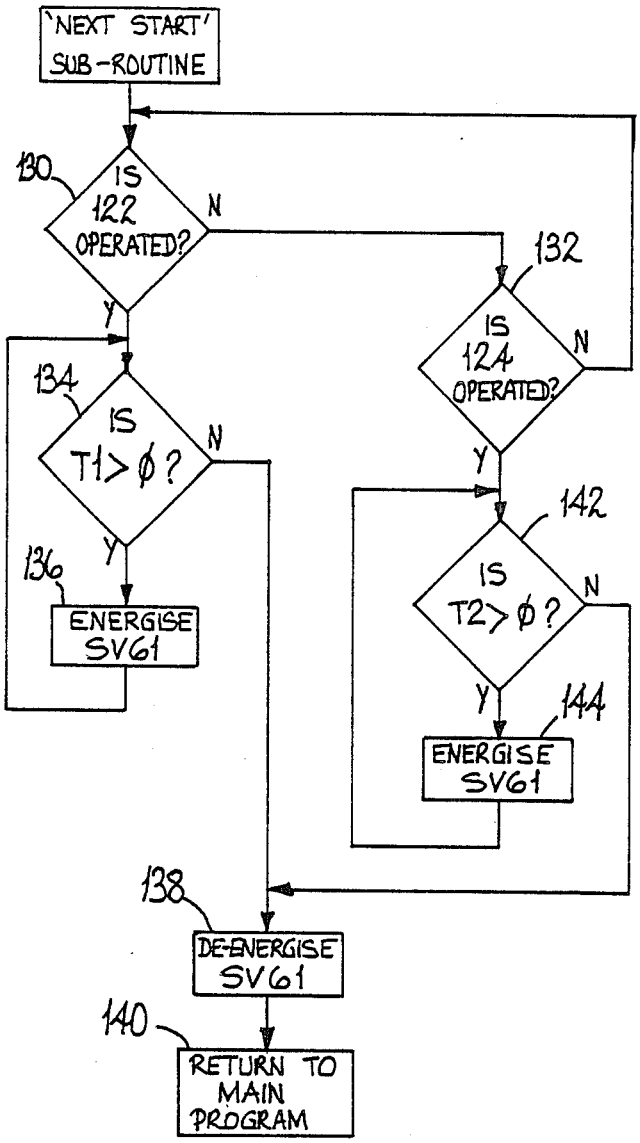
FIG. 4 is a flow chart relating to the operation of the selector means.

The control means serves inter alia for controlling the position of the heel support, more particularly the "next start" position as well as the operative position thereof. With reference to FIG. 4, the status of the first selector button 122 is monitored by the electronic circuitry (step 130); this button is used for setting the heel support for shoes of a shorter length, as opposed to the button 124, which is for shoes of a longer length. If the answer is "no" then at step 132 the status of the button 124 is interrogated. In the event that the answer to this interrogation is "no", the programme reverts to step 130. If the answer at step 130 is "yes" the programme looks to a value of a timer T1 (step 134). In the block diagram of FIG. 3 timers T1, T2 are shown for convenience as inputs to the programmable controller. The particular controller identified previously, however, incorporates timer functions together with a clock function C and these functions are utilised in the machine now being described for controlling the "next start" positions of the heel support 26. Addressing timer T1 thus initiates its timing out (assuming that its value is greater than zero), in which case at step 136 solenoid SV61 of valve SV6 is actuated to cause the heel support to move from its "shoe release" position in a direction towards the toe support. From step 136 the programme reverts to step 134 and continues in this path until the value of timer T1 equals zero; that is to say the timer has timed out. At this stage, the programme proceeds to step 138, de-energising solenoid SV61, and thus bringing the heel support to rest and locking it in position. Thereafter the programme passes to step 140 and thus returns to the main programme.

Where button 122 has not been depressed, but button 124 has, then the status of timer T2 is interrogated at step 142. In the present case, the value of T2 equals zero (this selected "next start" position being constituted by the retracted or "shoe release" position of the heel support), so that the programme proceeds directly to step 138, again instructing de-energisation of the (in this case already de-energised) solenoid SV61 and the sub-routine is then terminated at step 140. If of course the value of timer T2 is greater than zero, then solenoid SV61 would be actuated at step 144 and the same procedure would be followed as in the case of timer T1. It will be appreciated that any number of timers could be used according to the number of different "next start" positions required for the machine. In general, however, regardless of the number of such positions, it is likely that for the largest shoe the "shoe release" position will constitute one of the "next start" positions.

In an alternative embodiment, which is constituted by a pneumatically operated machine (not shown), the heel support arrangement (not shown, but generally similar to the arrangement 26) is carried by an ancillary pneumatically operated piston-and-cylinder arrangement which is itself supported on a block supported by the piston rod of a main piston-and-cylinder arrangement (not shown, but corresponding to the arrangeent 112). The operation of the latter arrangement is controlled by the electronic control circuitry, as described above. In the alternative embodiment, however, the sensing of the selector switches, instead of rendering a selected timer effective, now is effective to operate an appropriate solenoid valve thus to cause the piston rod of the ancillary piston-and-cylinder arrangement to be extended from or retracted into its cylinder, according to the switch selected. In this way the heel support arrangement is caused to be moved into a selected "next start" position. If desired, furthermore, the single ancillary piston-and-cylinder arrangement can be replaced by two or more such arrangements in known manner to provide further pre-set "next start" positions of the heel support arrangement.

In the operation of this alternative embodiment the sequence of operation is generally similar to that described above, except that during the retraction of the heel support arrangement at the end of the operating cycle the or each ancillary piston-and-cylinder arrangement is operated to move the heel support arrangement in a direction away from the toe support, thus to move it to its retracted position. Thereafter the or each ancillary arrangement is then re-actuated in accordance with the selection made by the operator.

We claim:

1. A machine for pulling over and lasting toe portions of shoe uppers comprising a toe support (10) for supporting, bottom down, the toe end portion of a shoe comprising a shoe upper on a last with an insole on the last bottom, and a pincer assembly (14) comprising an array of pincers (16,18) disposed about the toe support (10) for gripping lasting marginal portions of the toe end of the upper of a shoe supported by the toe support (10), wherein relative movement is effected, in a direction heightwise of the shoe, between said toe support (10) and said pincer assembly (14) whereby, with the lasting marginal portions of the shoe upper gripped as aforesaid, the toe end portion of the shoe upper can be tensioned over its last, the machine further comprising a heel support (26) which is movable towards and away from the toe support (10) between an operative position, in which the heel end portion of the shoe is engaged and supported thereby, and a next start position which it occupies in the rest condition of the machine, means (112) for moving the heel support (26) between its operative and "next start" positions, and wiper means (20) by which the lasting marginal portions of the toe portion of the shoe upper can be wiped over and pressed against corresponding marginal portions of the insole for securement thereto, characterised in that the heel support (10) has a plurality of pre-set "next start" positions, operator-actuatable selector means (122,124) being provided for selecting one of said positions according to the size of the next shoe to be operated upon, and in that the heel support (10), in moving from its operative position, is first moved to a retracted position, in which the shoe held thereby is released, and thereafter, according to the selection of the operator, assumes its selected "next start" position.

2. A machine according to claim 1 characterised in that said retracted position constitutes one of the selectable "next start" positions.

3. A machine according to claim 1 characterised in that the means (112) for moving the heel support (26) is hydraulically operated and in that electronic control circuitry is provided which incorporates a clock function (C), under the control of which the movement of the heel support (10) from its retracted position to its selected "next start" position takes place for a pre-set time interval.

4. A machine according to claim 3 characterised in that the selector means (122,124) comprises a plurality of selector switches (122,124), with each of which, one "next start" position is associated, the arrangement being such that the status of each switch (122,124) is monitored by the electronic circuitry, which controls the movement of the heel support (26) according to which of the switches is actuated.

5. A machine according to claim 1 wherein the means (112) for moving the heel support (26) into and out of its operative position includes a solenoid valve (SV6), characterised in that sensor means (118,120) is provided actuatable by engagement of the heel support (26) with the heel end portion of a shoe supported by the toe support (10), and further in that the status of the sensor means (118,120) is monitored by the electronic circuitry and, in the event of actuation of said sensor means (118,120), said solenoid valve (SV6), actuation of which causes the heel support (26) to move in a direction towards the toe support (10), is caused by said circuitry to be de-actuated whereupon the heel support (26) is locked in its operative position.

6. A machine according to claim 3 wherein the means (112) for moving the heel support (26) into and out of its operative position includes a solenoid valve (SV6), characterised in that sensor means (118,120) is provided actuatable by engagement of the heel support (26) with the heel end portion of a shoe supported by the toe support (10), and further in that the status of the sensor means (118,120) is monitored by the electronic circuitry and, in the event of actuation of said sensor means (118,120), said solenoid valve (SV6), actuation of which causes the heel support (26) to move in a direction towards the toe support (10), is caused by said circuitry to be de-actuated to a fluid locking position.

7. A machine according to claim 5 characterised in that the heel support (26) comprises a heel pad (100) which is mounted for movement relative to a fixed support member (108) of the heel support (26), such relative movement being sensed by and serving to actuate the sensor means (118,120).

8. A machine according to claim 7 characterised in that the heel pad (100) is carried by a slide (102) which is mounted on a support plate (106) for sliding movement relative thereto in a direction heightwise of the shoe, said support plate (106) being itself mounted for pivotal movement in relation to said fixed support member (108), such pivotal movement being sensed by and thus serving to actuate the sensor means (118,120).

9. A machine according to claim 7 characterised in that the sensor means (118,120) comprises an inductance device (118) which is carried by said fixed support member (108) and with which cooperates an actuator (120) movable with the heel pad (100), movement of the actuator (120) into proximity with the inductance device (118) serving to actuate the sensor means (119,120).

* * * * *